US006022422A

United States Patent [19]

Holmes

[11] Patent Number: 6,022,422

[45] Date of Patent: Feb. 8, 2000

[54] CLEANING SHOE FOR PIPE

[76] Inventor: Donald S. Holmes, 226 Homestead La., Remlap, Ala. 35133

[21] Appl. No.: 09/121,928

[22] Filed: Jul. 24, 1998

[51] Int. Cl.[7] ..... B08B 9/02

[52] U.S. Cl. ..... 134/8; 15/104.05; 15/104.16

[58] Field of Search ..... 15/104.03, 104.05, 15/104.095, 104.096, 104.15, 104.16; 134/8

[56] References Cited

U.S. PATENT DOCUMENTS

| | | | |
|---|---|---|---|
| 348,141 | 8/1886 | Rowell | 15/104.15 |
| 1,111,208 | 8/1914 | Blumenthal | 15/104.16 |
| 2,818,591 | 1/1958 | Joynes | 15/104.15 |
| 3,116,576 | 1/1964 | Block | 15/104.095 |
| 3,410,349 | 11/1968 | Troutman | 15/104.16 |
| 3,848,289 | 11/1974 | Bachman | 15/104.096 |
| 4,137,928 | 2/1979 | Sentell | 15/104.095 |
| 5,015,299 | 5/1991 | Schweder | 15/104.05 |

*Primary Examiner*—Terrence R. Till

*Attorney, Agent, or Firm*—Robert J. Veal; Veal & Bush, LLC

[57] ABSTRACT

A grinding shoe is designed to be a passive grinder which is advanced within the bore of a pipe being rotated in a typical pipe operation. Apparatus currently used to deliver reamer rocks on the end of a rotating lance can be modified to achieve considerable cost savings. Specifically, the apparatus utilizes a lance for advancing the shoe within the pipe without rotation. The shoe is affixed near the end of the lance in a selected attitude which determines the degree of grinding to be accomplished. A pair of shoe walls extending substantially paraxially with the rotating tube form a dual reaming head which engages the pipe interior across a chord over the bottom of the pipe.

16 Claims, 3 Drawing Sheets

CLEANING SHOE FOR PIPE

FIELD OF THE INVENTION

The present invention relates generally to the production of cast iron, steel, or plastic tubing and pipe. More particularly the present invention relates to the cleaning of the interior of such pipe to remove burrs, blisters and the like. In even greater particularity the present invention is a reversible double acting shoe mounted for non-rotating axial reaming within a rotating tube.

BACKGROUND OF THE INVENTION

The pipe industry produces thousands of linear feet of steel, cast iron, and plastic pipe each day. A substantial quantity of this pipe is coated internally as a part of the production process. Whether the pipe is coated or uncoated, most metallic pipe must be cleaned internally and at the spigot end to remove burrs and other imperfections. A number of systems have been used to attempt to clean the interior of the piping. Typically a lance will be mounted for axial movement into and out of the pipe and will carry grinding rocks or wire brushes or a combination of rocks and brushes. Normally, the grinding members, regardless of the type are rotated on or with the lance such that they are urged against the interior of the pipe, which is also rotating to smooth or finish the inside of the pipe. Accordingly, motors and belts to drive the rotating grinders must be maintained and replaced to keep the equipment running. Special lances with special heads must be produced to support and rotate the reamer rocks or brushes, and special bearings for the lances must be provided. All of these components are somewhat sacrificial in that the rocks and brushes are soon worn away, and the motors, belts, lances, and bearings all must be maintained and replaced. The cost of maintenance and repair is huge. In a typical installation where eight lances and reamers are used to process pipe, the cost of the first day's operation of the installation is in excess of $14,000.00. The cost of operation of an eight reamer facility over the course of a year could exceed $1,000,000.00. In addition to the cost factors, rotating reaming devices are extremely noisy and thus present workplace hazards which are becoming increasingly difficult to justify.

SUMMARY OF THE INVENTION

It is the object of the present invention to provide a reamer mechanism that yields superior cleaning of the interior of a pipe or tube.

It is another object of the invention to provide a reamer mechanism that yields superior performance at a lower cost.

It is still a further object of the invention to provide a reamer mechanism which reduces the noise level of operation of such equipment.

Still another object of the invention is to provide a reamer mechanism which reduces the time between maintenance events.

Yet another object of the invention is to provide a reamer mechanism which can clean the bell or spigot portion of a tube as well as the interior of the pipe.

These and other objects and advantages of my invention are accomplished by the novel and unique construction and utilization of my reamer head or shoe. My shoe is designed to be a passive grinder which is advanced within the bore of a pipe being rotated in a typical pipe operation. The apparatus which is currently used to deliver reamer rocks on the end of a rotating lance can be modified to achieve my purposes at considerable cost savings. Specifically, my apparatus utilizes a lance for advancing the shoe within the pipe without rotation. The shoe is affixed near the end of the lance in a selected attitude which determines the degree of grinding to be accomplished. A pair of shoe walls extending substantially paraxially with the rotating tube form a dual reaming head which engages the pipe interior across a chord over the bottom of the pipe.

BRIEF DESCRIPTION OF THE DRAWINGS

Apparatus embodying features of my invention is depicted in the accompanying drawings which form a portion of this disclosure and wherein.

DESCRIPTION OF THE PREFERRED EMBODIMENT

Figure 1:
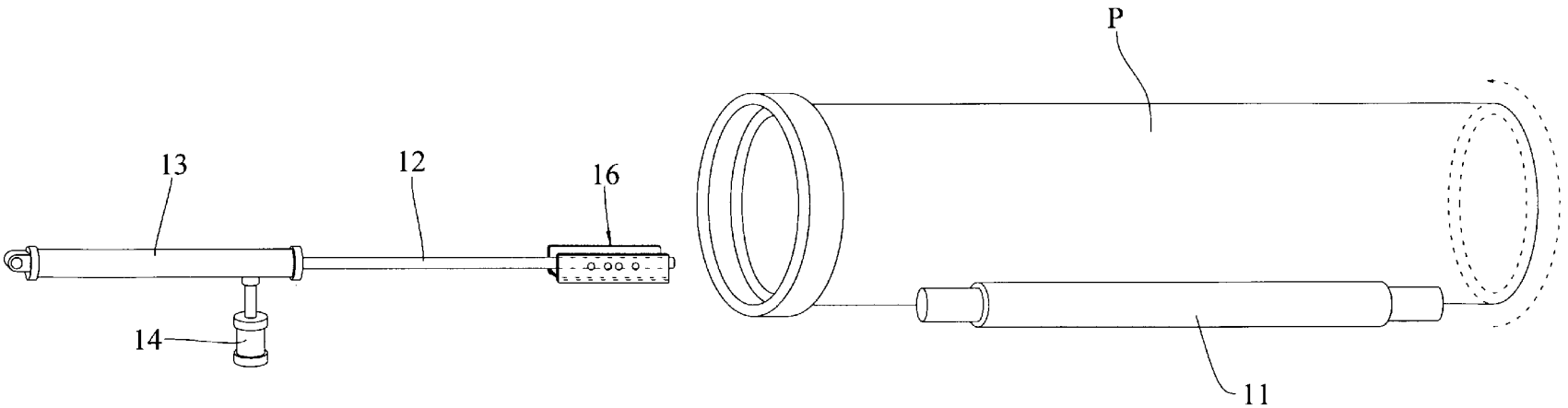
FIG. 1 is a pictorial representation of the equipment used to ream a pipe.

Referring to the drawings for a clearer understanding of the invention, it may be seen in FIG. 1 that the present invention is intended for use in a pipe P manufacturing facility wherein the pipe is rotated on a cradle 11 about a horizontal axis. A pair of lances 12 are mounted coaxially with pipe P, and are actuated by a set of actuators 13 and 14. Actuator 14 urges the lance 12 longitudinally within the pipe P while actuator 13 displaces the lance vertically to position a shoe 16 mounted on the end of each lance 12.

Figure 2:
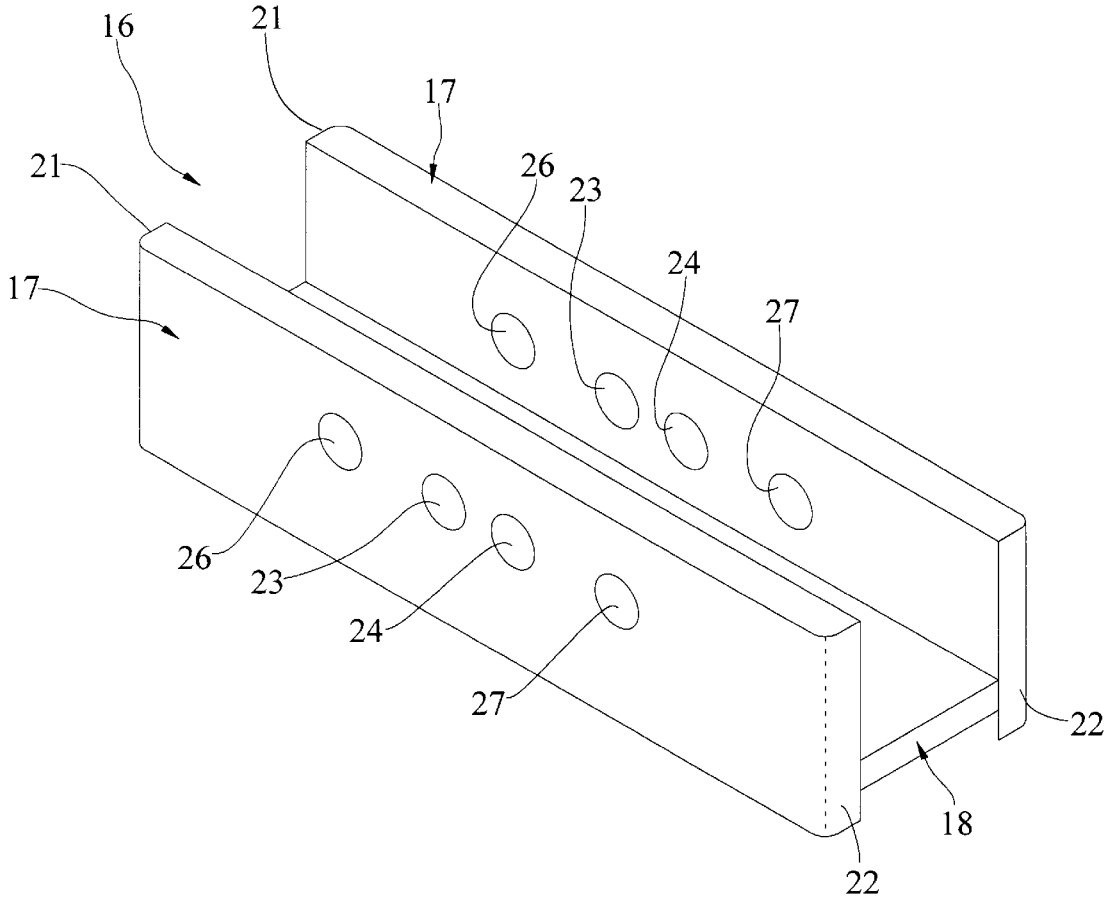
FIG. 2 is a perspective view of my shoe.
Figure 3:
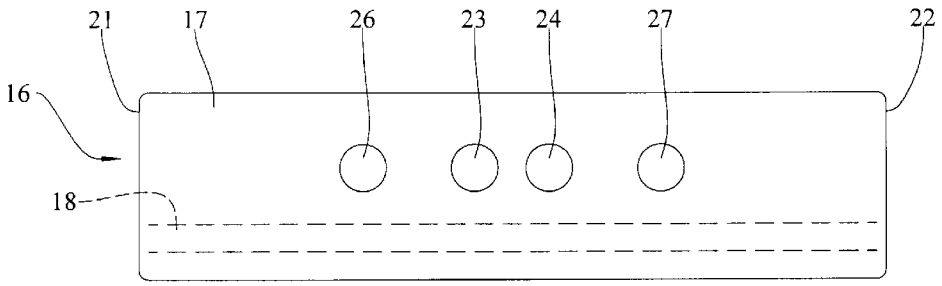
FIG. 3 is a side elevational view of the shoe.
Figure 4:
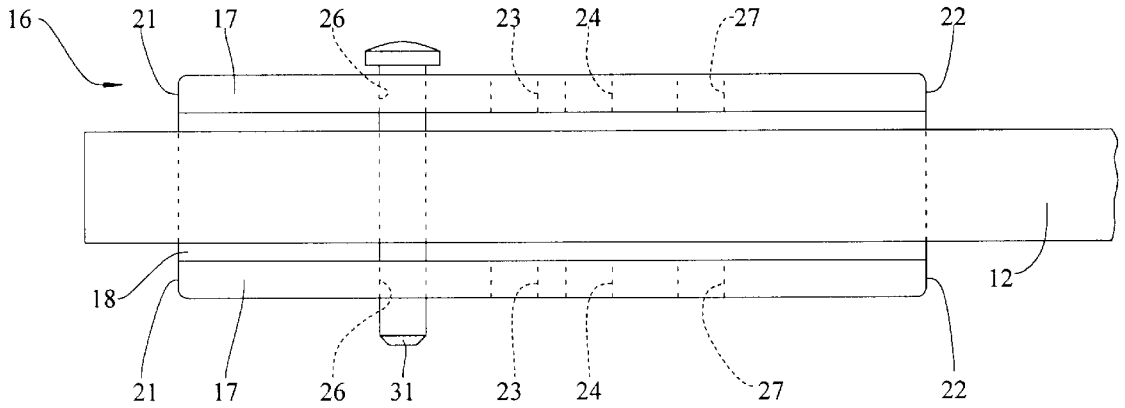
FIG. 4 is a plan view of the shoe attached to a lance.
Figure 5:
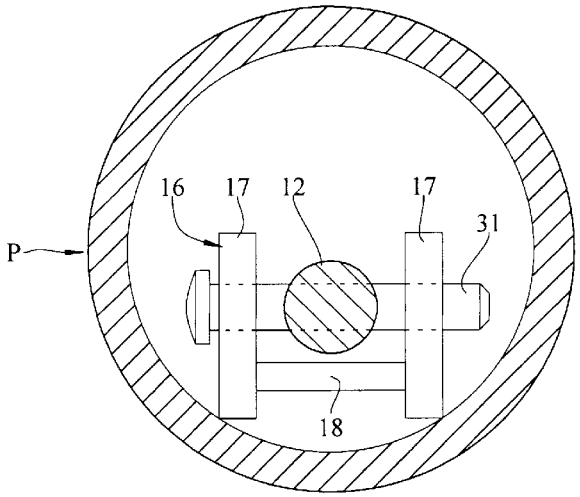
FIG. 5 is an end view of the shoe engaging the inner surface of a tube.

Referring to FIGS. 2 and 5, it may be seen that the each shoe 16 is generally H shaped in construction having a pair of side walls 17 and a transverse member 18. The side walls 17 are elongated, generally rectangular plates of a steel selected for its wear resistance and durability. In a preferred prototype each side wall 17 was measured ten inches in length and two and one half inches in height and was made from a plate which was one-half inch thick. Each shoe 16 is reversible, as explained hereinafter; however, for the purposes of illustration and explanation the side walls have two ends, designated front end 21 and rear end 22. Each side wall also has from two to four ⅝ inch apertures in it at particular locations. Apertures 23 and 24 are located with their centers one inch below the top of side wall 17 and four and one-half inches from the front and rear ends respectively. Thus, apertures 23 and 24 are separated by about one half inch and lie on opposite sides of the mid-point of the shoe. Apertures 26 and 27 likewise have their centers one inch below the top of side wall 17, but only three inches from the ends of the side wall. Transverse member 18 is welded to side walls 17 and in the prototype was ⅜ inch thick, ten inches long, and two inches wide. It should be positioned and welded with its upper surface ¾ inch above the bottom edges of side walls 17 and should not be over ½ inch thick. In an alternative embodiment for larger diameter pipe, the side walls 17 may be four and one-half inches high in which case transverse member is positioned at a height two and three quarter inches above the lower edge. As shown in FIGS. 3, 4, and 5, the shoe is affixed to the lance 12 by a pin or threaded connector 31 extending through lance 12 and apertures 26 closest to front end 21.

In operation, the shoe can be set for greater or lesser grinding pressure by selecting the apertures used to connect the shoe to the lance. Connecting the shoe to the lance using a pin through the aperture closest to the front end increases the pressure applied by the grinding head and yields a smoother bore. Consequently, the shoe also wears faster in this mode. It should be noted that wear on the shoe occurs between the forward end and the connecting bolt; therefore, as the forward end wears, the shoe may be reversed such that the relatively unworn rear end becomes the forward end; thus doubling the useful life of the shoe. It is also noteworthy to mention that each side wall acts as a grinding surface at opposite ends of a chord across the bottom of the pipe; hence, the shoe is reversible and double grinding.

A set of shoes built to the above specifications were used in a test to determine the feasibility of replacing a system using reaming rocks mounted on rotating lances. The shoes did a better job of reaming the inner diameter of the pipe and lasted twice as long as a reaming rock. Further, the down time for changing shoes as opposed to rocks yields a reduction of eighty percent. The cost per shoe is less than half the cost of a reamer rock and no drive motor belts or specialized lances and bearings are needed using the shoe. Consequently, the estimated savings in incorporating the instant invention at the test facility would yield a savings of $14,300.00 the first day, future savings due to the reduction in spare parts for motors, special heads, belts, rocks, and bearings.

It will also be appreciated that if bubbles form on cement lining inside lined pipes, the instant shoes can be used to grind down the bubbles such that the pipe may be relined without returning to the annealing process.

While I have shown the invention in only one form, it is to be appreciated that it may be practiced in any manner and form consistent with the appended claims.

What I claim is:

1. Apparatus for cleaning the inside of rotating pipe comprising:

a. shoe means for engaging the interior of a rotating pipe and grinding said interior to a smooth finish; wherein shoe means comprises an elongated generally H shaped member, having spaced apart side walls and a transverse member affixed therebetween, b. means for supporting said shoe means inside said rotating pipe in engagement with the surface thereof in fixed angular relation to said pipe; said side walls having cooperative apertures therein positioned along the length thereof such that said shoe means may be selectively connected to said means for supporting by members extending through said cooperative apertures; and c. means for moving said shoe means axially along the length of said rotating pipe.

2. Apparatus as defined in claim 1 wherein said H shaped member is made of steel.

3. Apparatus as defined in claim 1 wherein said side walls have rounded forward and rearward edges.

4. Apparatus as defined in claim 1 wherein said transverse member is affixed to said side walls at the longitudinal midline of said side walls.

5. Apparatus as defined in claim 1 wherein said apertures are spaced from either end of said shoe means such that connection to said supporting means using the apertures closest to the end supports said shoe at an angle of four to ten degrees from the centerline of said side walls.

6. Apparatus as defined in claim 1 wherein said shoe means is pivotally connected to said supporting means by a member extending through opposing apertures such that the inclination of said shoe means is variable by up to fifteen degrees from a longitudinal reference line passing through the center of the spaced apart apertures on a side wall.

7. Apparatus as defined in claim 6 wherein said supporting means comprises an elongated lance received between said side walls and connected thereto by a transverse member.

8. Apparatus as defined in claim 7 wherein said H shaped member is made of steel.

9. Apparatus as defined in claim 8 wherein said side walls have rounded forward and rearward edges.

10. Apparatus as defined in claim 9 wherein said transverse member is affixed to said side walls at the longitudinal midline of said side walls.

11. In an apparatus for cleaning the inside of a pipe rotating about a center line including a supporting lance reciprocally mounted for axial insertion and retraction within said pipe, the improvement comprising: a shoe removably affixed proximal the end of said lance at a fixed angular position in relation to said centerline said shoe defining a wear surface held in contact with the inner surface of said pipe.

12. The improvement as defined in claim 11 wherein said shoe is generally H shaped including opposing side walls connected by a transverse member, said walls having cooperative apertures formed therein for pivotally affixing said shoe to a pin extending transversely to said lance.

13. The improvement as defined in claim 12, wherein said apertures are positioned in said side wall relative to said transverse member to cooperatively support said shoe on said lance at an inclination defined by the separation of said aperture from a selected end of said shoe and from said transverse member.

14. The improvement as defined in claim 12 wherein the forward most and rearmost surfaces of said shoe are arcuate.

15. The improvement as defined in claim 11 wherein said lance and shoe are not rotatable within said pipe.

16. The method for cleaning the interior diameter of a pipe comprising the steps of:

a. supporting said pipe for rotation about its longitudinal axis and rotating said pipe at a predetermined speed, b. mounting an H-shape metallic shoe to a first end of a lance for limited pivotal motion relative to said lance;

c. inserting said first end of said lance into the interior of said pipe and lowering said shoe into contact with the surface of said pipe such that the lower portions of said shoe contact said pipe along a chord formed therein; and, d. advancing and retracting said lance within said pipe to move the shoe along a length of the pipe to be cleaned such that the rotation of the pipe against the shoe grinds the interior surface of the pipe until sufficient cleaning has occurred.

* * * * *